US005423307A

United States Patent [19]

Okawa et al.

[11] Patent Number: 5,423,307

[45] Date of Patent: Jun. 13, 1995

[54] AIR-FUEL RATIO CONTROL SYSTEM FOR INTERNAL COMBUSTION ENGINE HAVING IMPROVED AIR-FUEL RATIO-SHIFT CORRECTION METHOD

[75] Inventors: Koji Okawa, Toyota; Mitsuru Takada, Aichi; Nobuyuki Kobayashi, Toyota, all of Japan

[73] Assignee: Toyota Jidosha Kabushiki Kaisha, Toyota, Japan

[21] Appl. No.: 85,571

[22] Filed: Jun. 30, 1993

[51] Int. Cl.[6] ..... F02M 51/00

[52] U.S. Cl. ..... 123/698

[58] Field of Search ..... 123/698, 674, 675, 520, 123/479, 692, 696, 571, 684, 489

[56] References Cited

U.S. PATENT DOCUMENTS

| | | | |
|---|---|---|---|
| 4,130,095 | 2/1978 | Bowler et al. | 123/698 |
| 5,048,492 | 9/1991 | Davenport et al. | 123/489 |
| 5,048,493 | 9/1991 | Orzel et al. | 123/489 |
| 5,085,194 | 2/1992 | Kuroda et al. | 123/479 |
| 5,090,388 | 2/1992 | Hamburg et al. | 123/489 |
| 5,143,040 | 9/1992 | Okawa et al. | 123/684 |
| 5,150,696 | 9/1992 | Kabasin et al. | 123/571 |
| 5,216,997 | 6/1993 | Osani et al. | 123/698 |
| 5,216,998 | 6/1993 | Hosoda et al. | 123/698 |
| 5,224,462 | 7/1993 | Orzel | 123/696 |
| 5,228,421 | 7/1993 | Orzel | 123/489 |
| 5,245,978 | 9/1993 | Orzel | 123/674 |
| 5,257,613 | 11/1993 | Monda et al. | 123/674 |
| 5,267,548 | 12/1993 | Rosenzopf et al. | 123/692 |
| 5,299,546 | 4/1994 | Kato et al. | 123/520 |

FOREIGN PATENT DOCUMENTS

| | | | |
|---|---|---|---|
| 62-206262 | of 1987 | Japan | 123/698 |
| 2-94339 | of 1990 | Japan | 123/698 |
| 2-130240 | of 1990 | Japan | 123/698 |

*Primary Examiner*—Raymond A. Nelli
*Attorney, Agent, or Firm*—Kenyon & Kenyon

[57] ABSTRACT

An air-fuel ratio control system for an internal combustion engine which includes an evaporative fuel purge system having a canister for temporarily storing fuel vapor, detects an air to fuel ratio in the exhaust gas from the engine. An air-fuel ratio controller controls the air-fuel ratio in exhaust gas from the engine by varying a fuel quantity supplied to the engine so that the air-fuel ratio approaches a predetermined target air-fuel ratio. The evaporated fuel is purged from the canister at a specific purging rate determined based on engine operating conditions. An air-fuel ratio-shift is controlled based on the derivation of an amount by which the air-fuel ratio has shifted from the target air-fuel ratio due to a cause independent of the purging operation. The first amount, which is relatively constant over time in comparison to a second amount of air-fuel ratio shift occurring as a result of the purging operation, is derived based on a first detected air-fuel ratio-shift amount when the purge system is purging at a first purging rate. The second air-fuel ratio-shift amount is detected when the purge system is purging at a second purging rate different from the first purging rate.

13 Claims, 8 Drawing Sheets

AIR-FUEL RATIO CONTROL SYSTEM FOR INTERNAL COMBUSTION ENGINE HAVING IMPROVED AIR-FUEL RATIO-SHIFT CORRECTION METHOD

BACKGROUND OF THE INVENTION

1. Field of the Invention

The present invention relates to an air-fuel ratio control system for an internal combustion engine and it particularly relates to an air-fuel ratio control system for an internal combustion engine which system has an evaporated-fuel purging system and which system has a learning and a control function.

2. Description of the Related Art

A known internal combustion engine includes an evaporated-fuel purge system having a canister for temporarily storing evaporated fuel. (The evaporated-fuel purging system temporarily stores fuel evaporated from the fuel tank, which tank is used for supplying fuel to the internal combustion engine. The evaporated-fuel purging system purges the stored fuel when a predetermined condition is met.) This engine further has an air to fuel ratio sensor located in an exhaust-gas passage used for discharging exhaust gas generated in the internal combustion engine. The engine that controls an air-fuel ratio so as to cause the air-fuel ratio to be a predetermined target air-fuel ratio. This controlling is executed by correcting a fuel injection quantity according to feed-back correction factors (FAF). The feed-back correction factors (FAF) are appropriately determined according to the variation of the detected air-fuel ratio. The fuel injection quantity is a fuel quantity being injected to the internal combustion engine for the combustion operation in the engine.

This engine may also include a control system for determining a basic fuel-injection-quantity used in a combustion process in the internal combustion engine. In this case, this determination is executed using an internal pressure of a surge tank provided in the internal combustion engine and using an engine rotation speed. The surge tank internal pressure is obtained from measuring the pressure by means of an intake-air pipe pressure sensor. In the internal combustion engine, this intake-air pipe pressure is used for determining the relevant intake-air quantity.

The above-mentioned determination of the basic fuel-injection-quantity is executed according to a predetermined basic fuel-injection-quantity map. However, the basic fuel-injection-quantity map may need an appropriate correction due to variation of the characteristics in the internal combustion engine. This variation occurs due to the prolonged passage of time in the engine. This variation may result from undesirable variations (degradations) including shift (variation) of characteristics in various sensors and actuators (for example, an injector) used in the engine.

To overcome the variations due to the prolonged passage of time, the above-mentioned control system for determining the basic fuel-injection-quantity has a function to learn an effect resulting from the variation due to the prolonged passage of time. The effect may degrade the above-mentioned air-fuel controlling operation efficiency. The control system has learning values resulting from the learning, which learning value are used for eliminating the effects resulting from the variation due to the prolonged passage of time. These learning values may be respectively provided for a plurality of engine-condition ranges. These ranges may have been previously obtained by dividing the entire internal-combustion-engine conditions into a plurality of engine-condition ranges, the dividing depending on intake-air pipe pressures occurring during the engine combustion operation. The above-mentioned learning values may be corrected by varying (updating) them according to the variations of the characteristics in the engine due to the prolonged passage of time. This correction of the learning values may be achieved using the variation ranges of the above-mentioned FAF.

The Japanese Utility-Model Laid-Open Application No. 61-206262 discloses an air-fuel ratio control system such as mentioned above. The disclosed system has a solenoid valve located in a passage connecting the canister and the intake-air passage provided downstream of the throttle valve. This solenoid valve is used for cutting off the connection passage by closing the solenoid valve and used for connecting the canister and the intake-air passage by opening the valve. The solenoid valve is in its open condition while the engine is in a particular operation condition. This opening of the solenoid valve causes the evaporated fuel stored in the canister to be purged to the intake-air passage.

This purging causes the above-mentioned FAF to vary accordingly because the air to fuel ratio sensor detects the increase in the amount of fuel. However this variation of FAF does not result from the above-mentioned variation in the engine characteristics due to the prolonged passage of time. Thus, it is needed to eliminate the variation of FAF affecting the learning values. To eliminate these effects, the updating of the learning values is to be executed using the variation of FAF occurring while the solenoid valve is closed so as to stop the purging of the evaporated fuel (This action will be referred to as "purge cut" hereinafter).

Drawbacks in the above-mentioned system will now be described. As mentioned above, the purge cut needs to be executed so as to update the learning values. The more times the learning values are updated in response to possible engine characteristics variation due to the prolonged passage of time, the more appropriately and thus the more efficiently the air-fuel ratio control operation may be executed. However, updating the learning-value may result accordingly in the purge cut needing execution many times. This repeated purge-cut reduces the evaporated fuel quantity being purged from the canister and thus causes problems such as excess storing of the evaporated fuel in the canister, which excess storing may cause leaking of the evaporated fuel to the atmosphere. Such problems may become serious problems when an automobile has been stopped for a long time under an excessively hot atmospheric condition.

SUMMARY OF THE INVENTION

An object of the present invention is to provide an air-fuel ratio control system for an internal combustion engine wherein appropriate updating of learning values is executed. The updating is executed without effect to the evaporated-air purging. Further in the air-fuel ratio control system to be provided, the appropriate updating may be executed while sufficient evaporated-fuel purging is ensured. Thus, appropriate air-fuel controlling may be achieved while eliminating problems occurring due to insufficient evaporated-fuel purging.

To achieve the object of the present invention, the air-fuel ratio control system according to the present invention comprises:

air to fuel ratio detecting means for detecting the air-fuel ratio in exhaust gas discharged from said internal combustion engine;

air-fuel ratio control means for controlling air-fuel ratio in exhaust gas discharged from said internal combustion engine, said controlling being executed by varying fuel quantity supplied to said internal combustion engine, said controlling being executed so that said air-fuel ratio is a predetermined target air-fuel ratio;

purging means for purging evaporated fuel, which evaporated fuel has been temporarily kept in a canister, said purging being executed at a predetermined purging rate;

air-fuel ratio-shift correction means for optimizing the air-fuel ratio controlling, said air-fuel ratio controlling being executed by said air-fuel ratio control means, wherein said air-fuel ratio-shift correction means comprises an air-fuel ratio-shift deriving means for deriving a relatively-constant air-fuel ratio shift-amount, which relatively-constant air-fuel ratio shift-amount is an amount by which the air-fuel ratio has shifted from said target air-fuel ratio, this shift occurring, for example, due to a cause without relation to the purging executed by said purging means, which shift amount is relatively constant in comparison to shift amount occurring as a result of the purging operation executed by said purging means; and wherein said constant air-fuel ratio-shift correction means derives said relatively-constant air-fuel ratio shift-amount using a first air-fuel ratio shift-amount and a second air-fuel ratio shift-amount, which first air-fuel ratio shift-amount results from detecting, by means of said air to fuel ratio detecting means, when said purging means purges at a first purging rate and which second air-fuel ratio shift-amount results from detecting, by means of said air to fuel ratio detecting means, when said purging means purges at a second purging rate.

In this construction, any purge cut operation such as described above is not needed in an operation for updating learning values. Instead of a purge cut, the two kinds of air-fuel ratio shift-amounts are used to obtain the relatively-constant air-fuel ratio shift-amount. The relatively-constant air-fuel ratio shift-amount may occur due to, and thus may correspond to, the above-mentioned engine-characteristics variation due to the prolonged passage of time. Thus, the obtaining of the relatively-constant air-fuel ratio shift-amount results in the appropriate updating of the learning value and thus results in achieving appropriate, and thus efficient (or optimum), air-fuel ratio control function.

Other objects and further features of the present invention will become more apparent from the following detailed description when read in conjunction with the accompanying drawings.

DESCRIPTION OF THE PREFERRED EMBODIMENT

A principle of an embodiment of the air-fuel ratio control system for internal combustion engine will now be described with reference to FIG. 1.

In the embodiment, the term "air-fuel ratio" means a weight ratio of air to fuel, which air and fuel are fed to the relevant internal combustion engine for the combustion operation in the engine. Further, the term "purging rate" means a volume ratio of a gas quantity being purged to an intake-air quantity taken into the relevant internal combustion engine when the evaporated fuel quantity is purged from the canister.

Figure 1:
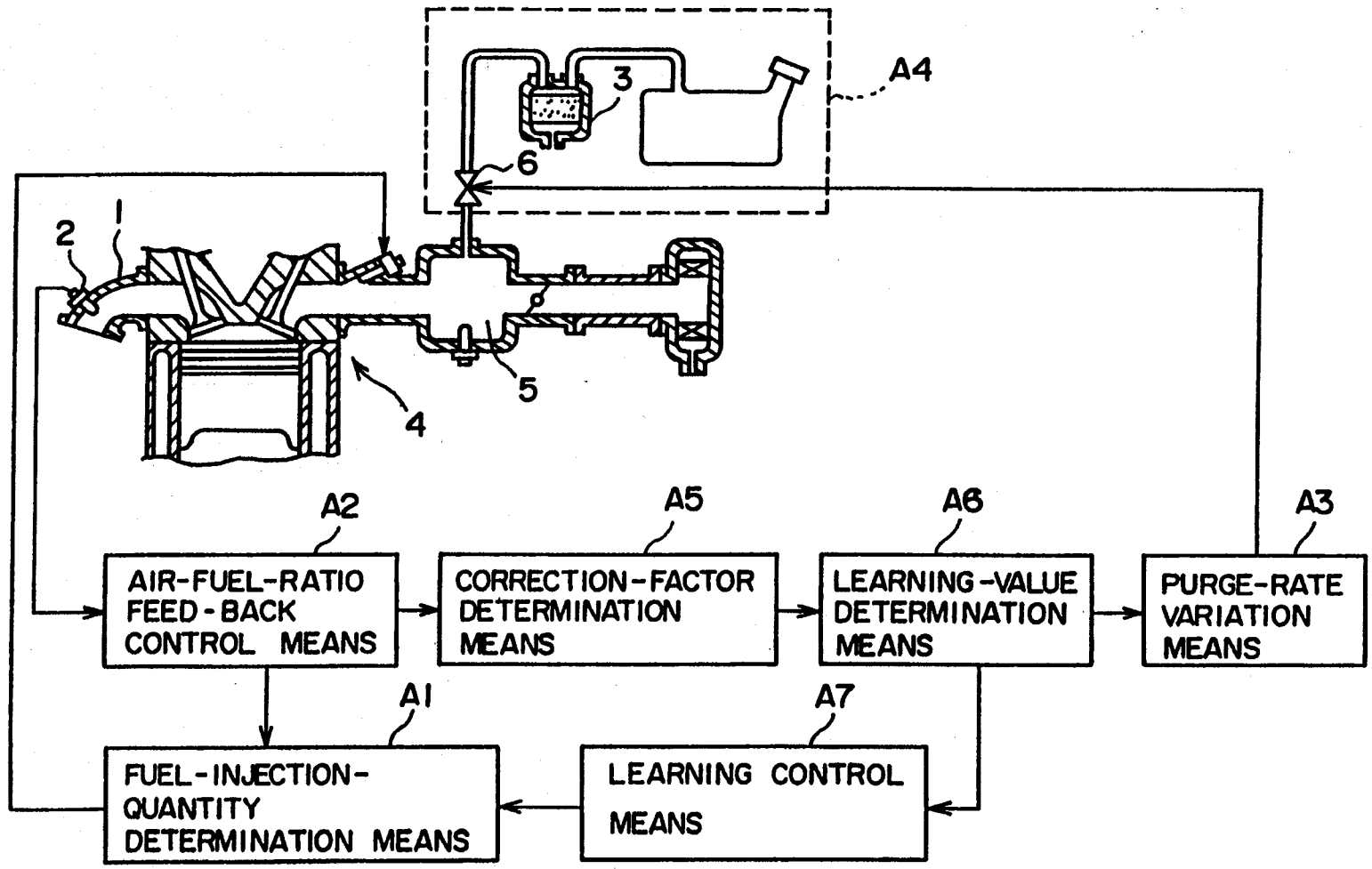
FIG. 1 shows a principle of an embodiment of the present invention.

The air-fuel ratio control system shown in FIG. 1 comprises fuel-injection-quantity determination means A1 for determining fuel-injection-quantities according to various engine-combustion conditions.

The system further comprises air-fuel ratio feed-back control means A2. The air-fuel ratio feed-back control means A2 determines air-fuel ratio correction factors successively in response to time elapsing. The determination is executed based on air-fuel ratio detection by means of the air to fuel ratio sensor 2. The air to fuel ratio sensor 2 is located in the exhaust-gas passage (1) provided in the internal combustion engine 4. The air-fuel ratio feed-back control means A2 then controls the fuel-injection-quantity determination means A1 according to the determined air-fuel ratio correction factors. This control of the fuel-injection-quantity determination means A2 is executed so as to make an actual air-fuel ratio approach predetermined target air-fuel ratio.

The air-fuel ratio control system shown in FIG. 1 further comprises an evaporated fuel purging system A4. The purging system A4 purges evaporated fuel temporarily stored in the canister 3 so that the purged fuel is supplied to the intake-air passage 5 provided in the internal combustion engine 4. The purging system A4 further comprises purge variation means A3 and 6 for varying a purging rate at which the evaporated fuel is purged as mentioned above.

The air-fuel ratio control system shown in FIG. 1 further comprises correction-factor determination means A5. The means A5 determines average air-fuel ratio correction factors each of which is obtained by averaging the above-mentioned air-fuel ratio correction factors at predetermined time intervals.

The air-fuel ratio control system shown in FIG. 1 further comprises learning-value determination means A6. The means A6 obtains a first a second average air-fuel ratio correction factor from among the average air-fuel ratio correction factors determined by the means A5. The first and second average air-fuel ratio correction factors respectively correspond to two conditions. In the two conditions, the evaporated fuel is respectively purged by means of the system A4 at different purging rates. The means A6 then determines a relevant air-fuel ratio shift-amount which does not include any amount occurring due to the effect of the evaporated-fuel purging. The means A6 then determines relevant learning values using the determined relevant air-fuel ratio shift-amount.

The air-fuel ratio control system shown in FIG. 1 further comprises learning control means A7. The means A7 achieves an optimum operation for determining the appropriate fuel-injection-quantity which results in an actual air-fuel ratio being the predetermined target air-fuel ratio. The target air-fuel ratio is achieved by effectively utilizing the learning value determined by the learning-value determination means A6.

An operation executed by the above-mentioned air-fuel ratio control system will now be described with reference to FIGS. 2A, 2B and 3.

Figures 2A, 2B:
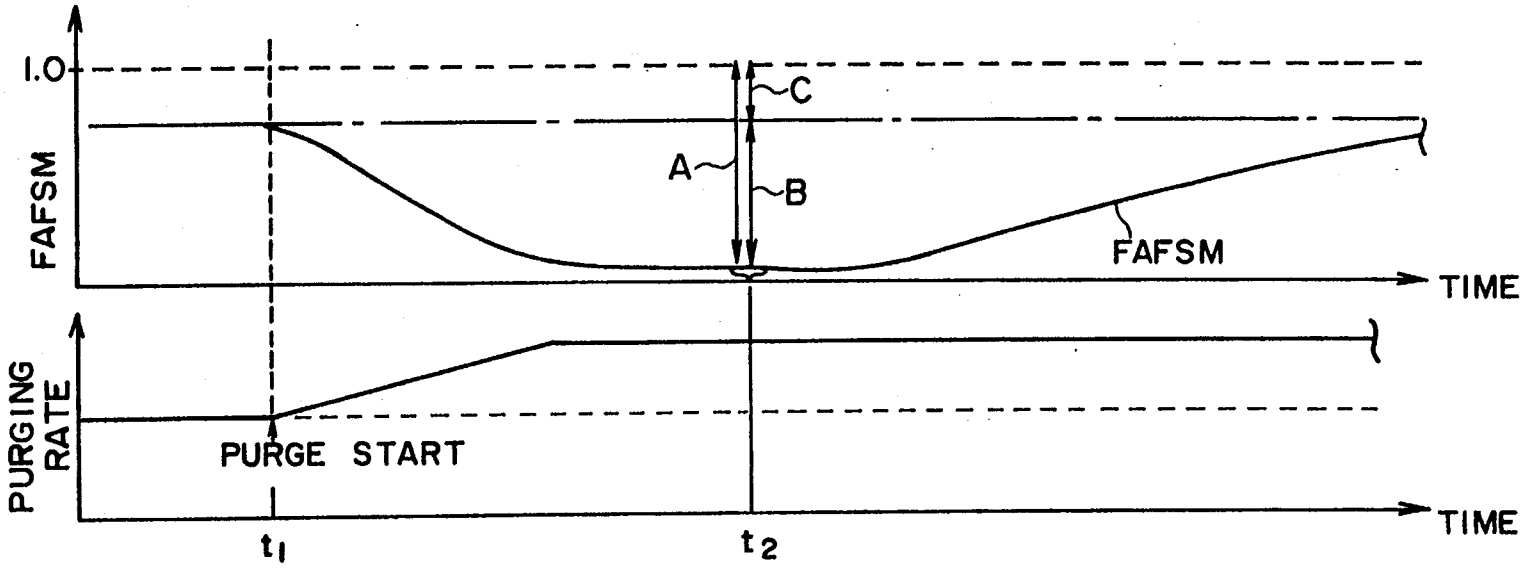
FIGS. 2A and 2B show time charts to be used in a description of a basic function of the embodiment.

FIG. 2A shows the variation of average air-fuel ratio correction factors, which variation occurs in response to time elapsing. The term "average air-fuel ratio correction factor" will be abbreviated "FAFSM" hereinafter. FAFSM is determined by the correction-factor determination means A5 using air-fuel ratio correction factors as mentioned above. The term "air-fuel ratio correction factor" will be abbreviated "FAF" hereinafter. FAF is determined by the air-fuel ratio feed-back means A2 as mentioned above. FIG. 2B shows the variation of purging rates, which purging is executed by the evaporated-fuel purging system A4 as mentioned above. The variation occurs in response to the above-mentioned time elapsing. Thus, FIGS. 2A and 2B show the variation of FAFSM in conjunction to the variation of purging rates with respect to the same time interval.

In FIGS. 2A and 2B, evaporated-fuel purging is started at a time $t_1$. This results in increasing fuel density in the fuel-air mixture and this increase is then detected by the air to fuel ratio sensor 2. This increase in the density of the fuel in the air-fuel mixture results in a corresponding air-fuel ratio-shift. This air-fuel ratio-shift is such that the air-fuel ratio is reduced due to the increase in the density of the fuel. Such an air-fuel ratio-shift occurring due to evaporated-fuel purging will be referred to as "purge shift" hereinafter. The above detection by means of the air to fuel ratio sensor 2 results in the air-fuel ratio feed-back control means A2 reducing FAF accordingly. This reducing of FAF makes the fuel-injection-quantity determination means A1 reduce the fuel injection quantity. The reduction of fuel injection quantity then results in the reduced air-fuel ratio being increased so as to become a stoichiometric air-fuel ratio. (The stoichiometric air-fuel ratio is an air-fuel ratio wherein an oxygen quantity is included. The oxygen quantity is necessary for completely oxidizing fuel included in the relevant air-fuel mixture in the internal combustion engine. However, the amount of oxygen should not exceed the necessary quantity.) In this case, the stoichiometric air-fuel ratio is a predetermined target air-fuel ratio. The reduction of the FAF results in a corresponding reduction of FAFSM accordingly. This reduction of FAFSM is shown in FIG. 2A between the time $t_1$ and $t_2$.

Then, as the evaporated-fuel purging is executed, the evaporated fuel stored in the canister is reduced accordingly. Thus, fuel density included in the purged gas becomes gradually lower while the purging rate is held constant, as shown in FIG. 2B. This decreasing of the fuel density in the purged gas results in decreasing of the air-fuel ratio. This deceasing of the air-fuel ratio results in the FAF, and thus the FAFSM, being increased accordingly. This increasing of FAFSM is shown in FIG. 2A after the time $t_2$. As described above, purge shifts such as mentioned above affect FAFSM.

There may be other air-fuel shifts occurring for reason other than those associated with purge shifts such as mentioned above. The other air-fuel shifts may occur due to the prolonged passage of time. That is, the other air-fuel shifts may occur due to variation of characteristics in the air fuel ratio sensor 2 due to the sensor 2 being degraded due to the prolonged passage of time. This variation of characteristics includes measuring error in the sensor 2. Such an air-fuel ratio-shift as occurring due to the prolonged passage of time will be referred to as "time-passage shift" hereinafter. Such a time-passage shift further affects FAFSM. Thus, FAFSM is a value depending on air-fuel ratio-shifts occurring due to various factors.

In an example for FAFSM, that is, FAFSM in the time $t_2$ in FIG. 2A, FAFSM has a value, as a result of shifting, different from 1.0 by A as shown in FIG. 2A. FAFSM being "1.0" means that FAFSM does not affect the fuel-injection quantity. (However, another parameter may affect the fuel-injection quantity. The mentioned other parameter may include a parameter associated with a so-called warming-up increasing correction and/or a so-called acceleration increasing correction.)

This shift value A results from the air-fuel ratio-shift at the time $t_2$. The value A is obtained as a result of adding a value C to a value B as shown in FIG. 2A. The value B corresponds to a purge shift such as mentioned above at the time $t_2$, while the value C corresponds to a time-passage shift such as mentioned above at the time $t_2$.

Only the value C will be used for updating learning values such as mentioned above. These learning values will then be used for optimizing the air-fuel ratio control operation as mentioned above. However, at the time $t_2$, only the value A can be obtained. The obtained shift value A in FAFSM at the time $t_2$ in FIG. 2A includes not only the value C but also the value C as mentioned above. To obtain the value C so as to use it for learning-value updating, it is necessary to determine a ratio between the values B and C with respect to the value A in FIG. 2A.

In the related art, an amount of a time-passage shift such the value C in FIG. 2A is obtained using FAFSM while the evaporated-fuel purging is stopped, as mentioned above, for example, during the time before the time $t_1$ in FIG. 2A. However, as mentioned above, this method may cause problems such as insufficient purging or insufficient updating-operation times for learning values.

A method according to the embodiment of the air-fuel ratio control system according to the present invention will now be described with reference to FIG. 3. The method is to obtain an amount of a time-passage shift such as the value C in FIG. 2A. The method is characterized in that two FAFSM are first obtained, which two FAFSM respectively correspond to those in different evaporated-fuel purging rates. The two FAFSM are then used for determining the time-passage shift amount. In a graph of FIG. 3, the horizontal scale axis represents evaporated-fuel purging rates such as mentioned above, while the vertical scale axis represents total air-fuel ratio shift-amounts respectively including purge shift amounts and time-passage shift amounts as mentioned above. The total air-fuel ratio shift-amounts are respectively equivalent to how much a value of FAFSM differs from the value 1.0. This is because FAFSM are respectively determined according to the relevant total air-fuel ratio shift-amounts. This determination is executed by means of the air-fuel ratio feed-back control means A2 and the correction-factor determination means A5, as mentioned above.

There may be a case where the purging rate is determined as PG1 while the internal combustion engine 4 is under stable conditions; the determination being executed by means of the purging system A3 and A6. In this case, the relevant air-fuel ratio shift-amount is R1, as shown in FIG. 3. FAFSM corresponding to the amount R1 is determined by means of the correction-factor determination means A5.

The amount R1 consists of a purge shift amount and a time-passage shift amount, a ratio between these amounts not being determined, as mentioned above. Then, if it is supposed that R1 consists of only a purge shift amount, a vapor density characteristic may be obtained as shown by a dashed line F in FIG. 3. The "vapor density" is represented by the inclination of the dashed line F and is obtained by the following equation:

(vapor density characteristic)=(air-fuel ratio)/(purging rate).

Figure 3:
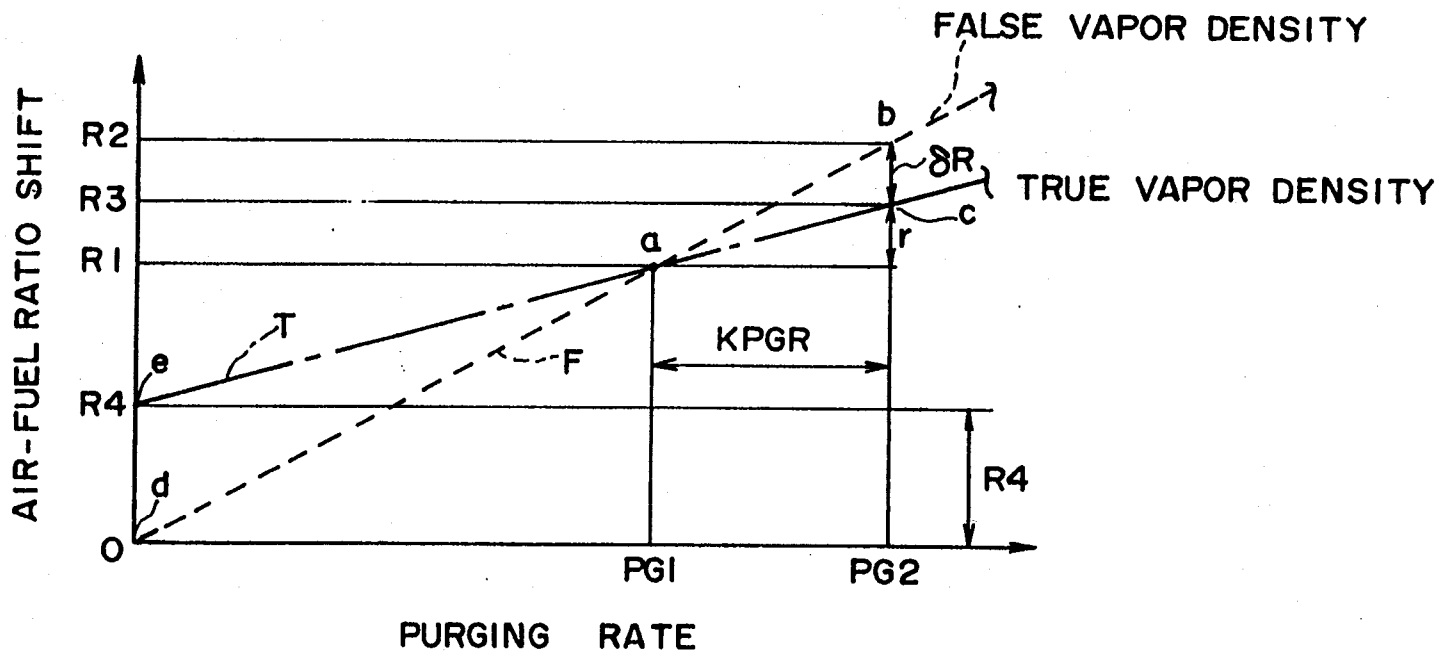
FIG. 3 shows a graph to be used in a description of the basic function of the embodiment.

Such a vapor density as represented by the line F is not a true vapor density but a false vapor density if R1 in FIG. 3 includes any time-passage shift amount. This is because the inclusion of the time-passage shift amount contradicts the above-mentioned supposition.

In this case, the chain line T in FIG. 3 represents the true vapor density characteristic. This line T corresponds to a linear function having its vertical scale axis, intercept, e as R4 as shown in FIG. 3. A reason for the line representing true vapor density characteristic not passing the origin d is existence of a time-passage shift amount. In this case, the time-passage shift amount is R4 shown in FIG. 3. Thus, R4 is a value needed for updating the relevant learning values as mentioned above.

The method according to the embodiment of the air-fuel ratio control system according to the present invention will now be described. The method includes obtaining an amount R4 shown in FIG. 3.

There may be another case, or the purging system A3 or A6 may define another case, where evaporated fuel is purged in a purging rate PG2 different from the above-mentioned purging rate PG1 as shown in FIG. 3. The difference in purging rates results in a corresponding difference in the air-fuel ratio-shift between the cases of the purging rates PG1 and PG2 accordingly. As a result, FAF varies due to the difference in the air-fuel ratio-shift. Thus, FAFSM varies accordingly. In this case, the air-fuel ratio shift-amount which this FAFSM corresponds to is R3 shown in FIG. 2. A point c representing the amount R3 at the purging rate PG2 is on the chain line T, as shown in FIG. 3.

Then, δR shown in FIG. 3, which is obtained as a result of subtracting R3 from R2, will be obtained as described below. Here, as mentioned above, R2 is obtained using the dashed line F based on the above-mentioned supposition while R3 is actually determined value FAFSM by means of the correction-factor determination means correspondingly to the purging rate is in PG2.

The actual difference in the air-fuel ratio shift-amounts due to the variation of the purging rates from PG1 to PG2 is represented by a difference r between R3 and R1, as shown in FIG. 3. The δR may be obtained by the following equation:

$$\delta R = R2 - R3 \quad (1).$$

The amount R1 can be obtained from the FAFSM determined for the air-fuel ratio shift-amount while the purging rate was PG1: while the amount R3 can be obtained from the FAFSM determined for the air-fuel ratio shift-amount while the purging rate was PG2. The amount R2 can be obtained by the following equation:

$$R2 = R1 * PG2/PG1 \quad (2).$$

Here: the symbol "*" means the mathematical operation symbol for multiplying the preceding value with the next value, while the symbol "/" means the mathematical symbol for dividing the preceding value by the next value. The above equation (2) for obtaining the amount R2 is arrived at using the dashed line F shown in FIG. 3, which line represents the following equation:

$$R2/R1 = PG2/PG1 \quad (3).$$

The equation (3) is substantially equivalent to the equation (2).

The value δR may be obtained by another method as follows. First, the air-fuel ratio control is carried out by means of the fuel-injection quantity determination means A1 using input from the learning control means A7. This air-fuel ratio control is carried out based on a supposition that no time-passage shift such as mentioned above exists, by reflecting the supposition on a relevant learning value set by the learning-value determination means A6. This air-fuel ratio control is carried out so as to correct a purge shift such as mentioned above. That is, this air-fuel ratio control is carried out based on a supposition that a vapor density such as mentioned above is the false vapor density characteristic shown as the break line F of FIG. 3.

Thus, if the above-mentioned supposition were true, no air-fuel ratio shift should occur under the above-mentioned air-fuel ratio control while the purging rate is PG2. However, this supposition is not true and there exists a time-passage shift corresponding to the value R4 shown in FIG. 3. That is, the actual vapor density characteristic is represented as the true vapor density shown as the chain line T shown in FIG. 3. Thus, an air-fuel ratio shift corresponding to the amount δR occurs under the above-mentioned air-fuel ratio control. Thus, δR is obtained by measuring the actual air-fuel ratio shift-amount by means of the air to fuel ratio sensor 2.

Then, the amount R4 corresponding to the time-passage shift amount will now be obtained using the obtained value δR. In FIG. 3, the triangle formed by vertexes a, b and c is similar to the triangle formed by vertexes a, e and d. Thus, the following equation holds:

$$PG1/(PG2-PG1)=R4/\delta R \quad (4).$$

Then, after the term (PG2−PG1) is replaced by KPGR, the equation (4) can be modified to the following equation:

$$R4=\delta R*PG1/KPGR \quad (5).$$

Thus, by using the equation (5), the amount R4 corresponding to the desired time-passage shift amount can be obtained.

The obtained time-passage shift amount R4 is then used in the learning-value determination means A6. The means A7 then updates a learning value KGi such as mentioned above so as to obtain the learning value KGi. This new learning value KGi is then utilized in the learning control means A7 so as to make the fuel-injection-quantity determination means A1 determine appropriate fuel injection quantity, as mentioned above. Thus, the learning value KGi can be updated and the updating operation does not include any effect resulting from evaporated fuel purging such as mentioned above. Thus, the updated learning value KGi can achieve appropriate and thus efficient (or optimum) air-fuel ratio control operation by using the determined appropriate fuel injection quantities. Furthermore, the updating can be executed while the evaporated-fuel purging operation is being executed. Thus, a problem, such as mentioned above, due to insufficient purging can be eliminated.

Figure 4:
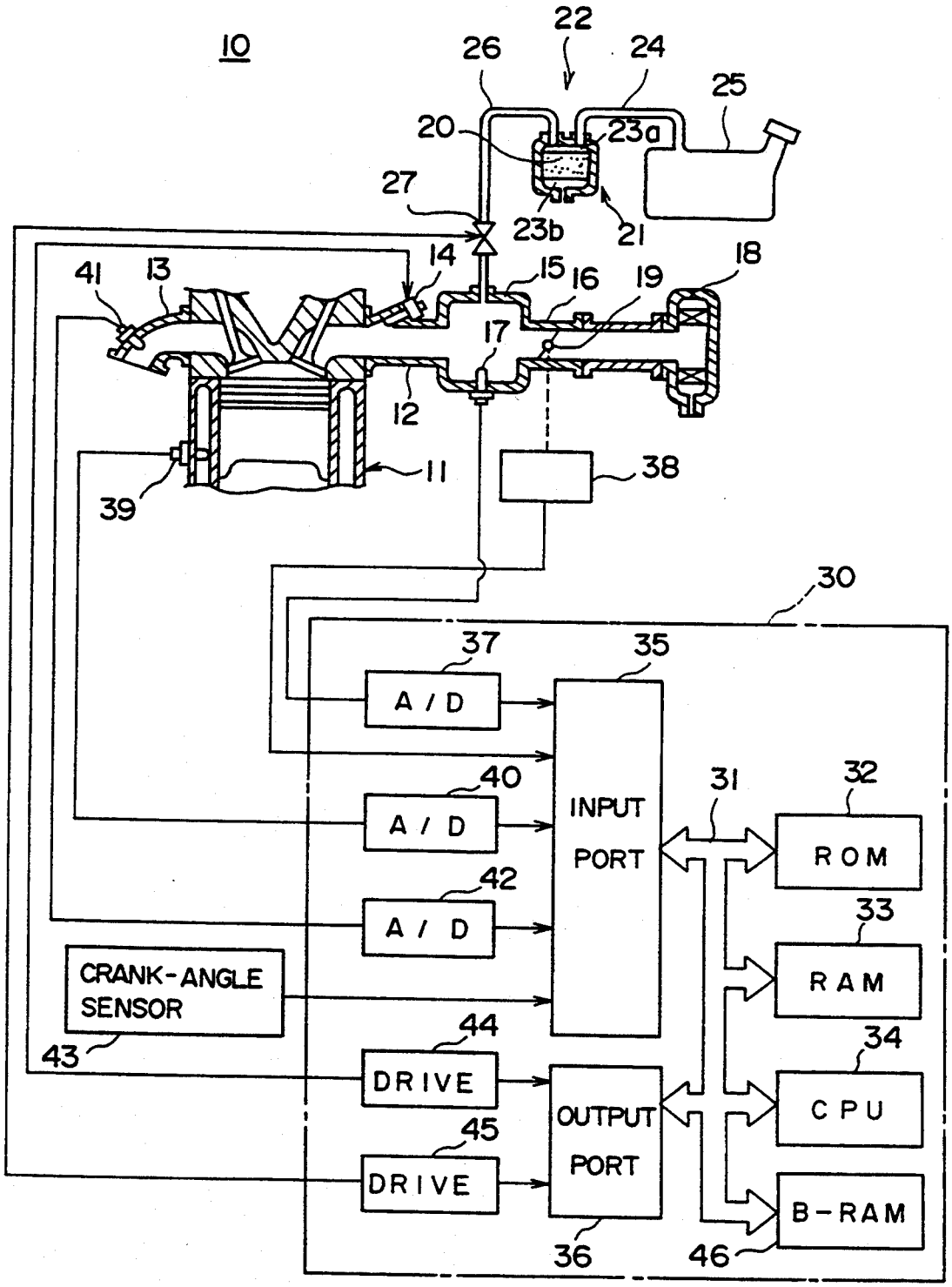
FIG. 4 shows a general construction of an internal combustion engine including the embodiment of the air-fuel ratio control system according to the present invention.

The embodiment of the air-fuel ratio control system for internal combustion engine according to the present invention will now be described in detail with reference to FIG. 4. FIG. 4 shows a general construction of an internal combustion engine 10 including the above embodiment of the air-fuel ratio control system. Further, FIG. 4 shows only parts of the engine 10, which parts correspond to one cylinder from among a plurality of cylinders of the engine 10.

The engine 10 shown in FIG. 4 comprises an engine body 11, a plurality of intake-air branch pipes 12(only one of them being shown in FIG. 4), a plurality of exhaust-gas manifold branch portions 13 (only one of them being shown in FIG. 4), a plurality of fuel injection valves 14 (only one of them being shown in FIG. 4)each of which valves is provided on a respective one of the plurality of intake-air branch pipes 12. Each intake-air branch pipe 12 is connected to a common surge tank 15. The surge tank 15 is connected to an air cleaner 18 via an intake-air duct 16. A throttle valve 19 is provided in the intake-air duct 16. An intake-air pressure sensor 17 is provided in the surge tank 15, which sensor 17 is used for measuring an intake-air pressure. The measuring is used for presuming an intake-air quantity.

The engine 10 has an evaporated-air purging system 22 such as mentioned above. The evaporated-air purging system 22 has a canister 21 therein. Active carbon 20 is contained in the canister 21. The canister 21 has a combustion vapor chamber 23*a* and an atmosphere chamber 23*b* at both top and bottom ends of the canister 21, as shown in FIG. 4. The combustion vapor chamber 23*a* is connected to a fuel tank 25 via a conduit 27. The combustion vapor chamber 23*a* is further connected to the surge tank 15 via a conduit 26. A purge control valve 27 is provided in the conduit 26, which valve 27 is controlled by an output signal provided from an electronic control unit 30.

Evaporated fuel generated in the fuel tank 25 is sent into the canister 21 via the conduit 24, and then absorbed by the active carbon 30. When the purge control valve 27 is opened, air is sent into the conduit 26 from the atmosphere chamber 23*b* via the active carbon 20. As the air passes through the active carbon 20, the evaporated fuel absorbed by the active carbon 20 is isolated from the active carbon 20. Then, the air, which air includes the evaporated fuel thus isolated from the active carbon 20, is purged into the surge tank 15 via the conduit 26. The air including the evaporated fuel is referred to as "vapor".

The electronic control unit 30 comprises a digital computer. The unit 30 includes ROM (Read Only Memory) 32, RAM (Random Access Memory) 33, CPU (Central Processing Unit or Microprocessor) 34, B-RAM (Back-up Random Access Memory) 46, an input port 35, and an output port 36. The parts 32, 33, 34, 46, 35 and 36 are connected to each other via a bi-directional bus 31. The intake-air pressure sensor 17 detects a pressure in the intake-air branch pipes 12. The sensor 17 then outputs a corresponding output signal to the input port 35 via an A/D converter 37.

A throttle switch 38 is associated with the throttle valve 19, and the switch 38 is in its ON state while the throttle valve 19 is in its idling opening state. An output signal provided by the throttle switch 38 is sent to the input port 35. A water temperature sensor 39 is provided in the engine body 11. The water temperature sensor 39 provides an output voltage proportional to a temperature of cooling water provided in the engine 10. The output voltage of the water temperature sensor 39 is sent to the input port 35 via the A/D converter 40. An air to fuel ratio sensor ($O_2$ sensor) 41 is provided on the exhaust manifold 13. An output signal provided by the sensor 41 is sent to the input port 35 via an A/D converter 42. Further, a crank angle sensor 43 is connected to the input port 35. The crank angle sensor 43 provides an output pulse each time the crank shaft of the engine rotates, for example, each time it rotates 30° CA, where CA stands for crank angle. The CPU 34 calculates an engine rotation speed (NE) using the output pulses provided by the crank-angle sensor 43. A fuel injection valve 14 and a purge control valve 27 are connected to the output port 36 respectively via corresponding drive units 44 and 45.

The above-mentioned means are made of a corresponding software program executed by the electronic control unit 30. These means include: the fuel-injection quantity determination means A1, air-fuel ratio feedback control means A2, purging-rate variation means A3, correction-factor determination means A5, learning-value determination means A6 and learning control means A7. A description with reference to FIGS. 5A and 5B, of kinds of air-fuel ratio-shifts such as mentioned above, including, for example, air-fuel ratio-shift occurring due to the prolonged passage of time, will now be given. Subsequently to the above mentioned description, operation flows executed by the electronic control unit 30 will be described, which flows concern the relevant air-fuel ratio control and learning control.

Such air-fuel ratio-shifts may occur due to, for example, the prolonged passage of time on sensors and actuators which sensors and actuators are part of the engine 10. The prolonged passage of time may cause characteristics thereof to shift, vary or to degrade. Reasons for such air-fuel ratio-shifts may be divided into two categories. A first such category includes a reason which causes an approximately constant shift in characteristics of, for example, a sensor. Such an approximately constant shift has no relation with an operation condition in the engine 10. Thus, an air-fuel ratio-shift caused by a reason in the first category causes an approximately constant shift amount without regard to an operation condition of the engine 10. However, such an approximately constant shift and thus such an air-fuel ratio-shift occurring thereby may actually slightly vary in response to the passage prolonged time.

In the embodiment shown in FIG. 4, to utilize such an air-fuel ratio in updating a learning value KGi such as mentioned above, the following process is executed. Here, this approximately constant shift remains an approximately constant amount without regard to an operation condition of the engine. The current learning value KGi are stored in storing areas provided in the B-RAM 46. Then, if the relevant air-fuel ratio varies as a result of, for example, characteristic variation in engine parts due to the prolonged passage of time, the learning value KGi is corrected accordingly so as to appropriately reflect the effects of the variation of the relevant air-fuel ratio on the air-fuel ratio control operation.

A second category of the above-mentioned two categories includes a reason which causes an air-fuel ratio-shift variation to depend on an operation condition in the engine 10.

In the embodiment shown in FIG. 4, in order to utilize an air-fuel ratio-shift in updating learning values KGi such as mentioned above, the following process is executed. Here, this air-fuel ratio-shift varies depending on an operation condition in the engine and varies as a result of characteristics variation due to the prolonged passage of time. The entire operation condition in the engine 10 is divided into a plurality of operation ranges. This division is executed so that, for example, the plurality of operation ranges respectively correspond to various intake-air pressures. Then, a plurality of learning values KGj are respectively provided for the plurality of operation ranges. Then, if the relevant air-fuel ratio varies as a result of, for example, characteristics variation doe to the prolonged passage of time, the learning values KGj are corrected accordingly so as to appropriately reflect the effect of the variation of the relevant air-fuel ratio on the air-fuel ratio control operation.

Figures 5A, 5B:
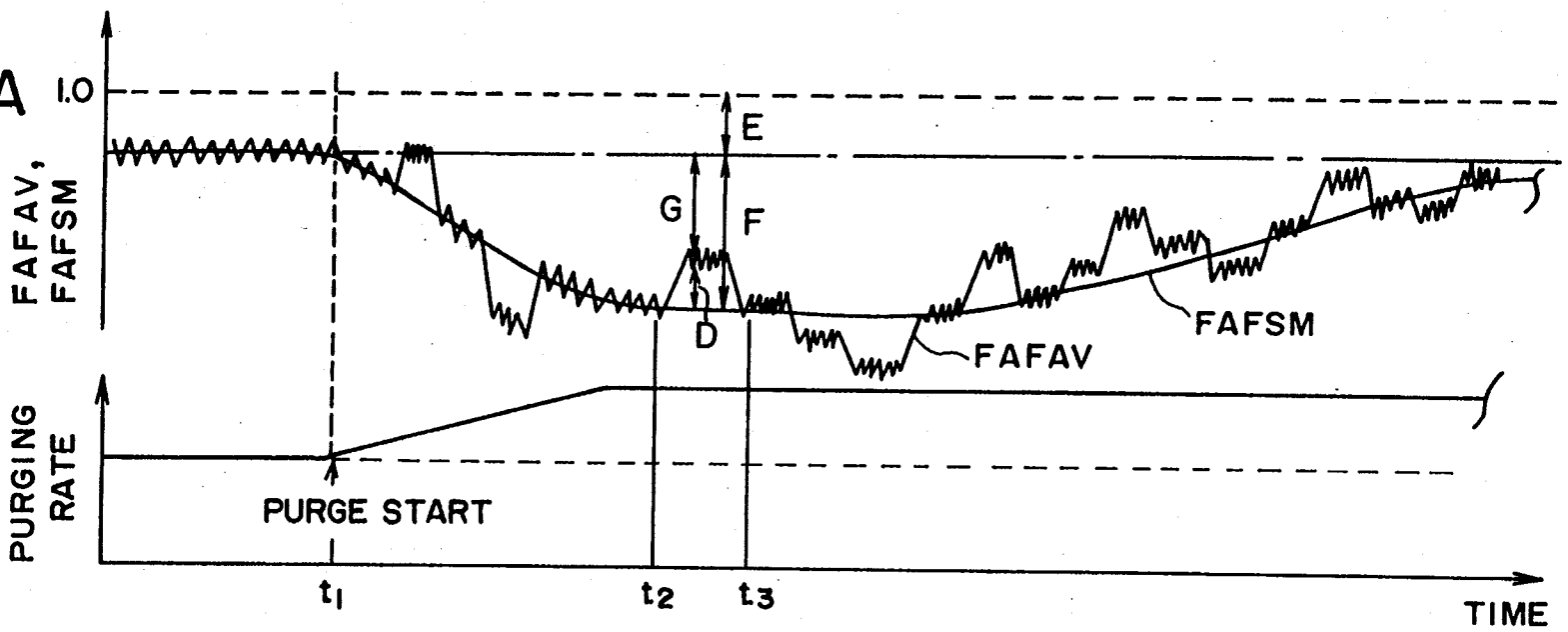
FIGS. 5A and 5B show time charts to be used in description of air-fuel ratio-shifts respectively occurring in the engine-condition ranges, which shifts occurring due to the prolonged passage of time.

FIG. 5A shows a long term average air-fuel ratio correction factor, which factor will be abbreviated "FAFSM". FAFSM is determined using air-fuel ratio correction factors, which factors will be abbreviated "FAF". FAF is determined by the air-fuel ratio feedback control means A2. FIG. 5A further shows a short term averaged correction factor, which factor will be abbreviated "FAFAV". FAFAV is determined using FAF. FIG. 5B shows purging rates, such as mentioned above, in purging executed by the evaporated-fuel purging system A4. At the time $t_1$, purging is started by means of the system A4.

FAFSM is obtained by averaging FAF over a relatively long time period. Thus, while FAF varies due to certain changes in the engine operation conditions, FAFSM does not vary according to the changes in the engine operation conditions. This mentioned certain changes in engine operation conditions causes the engine operation conditions to be in a different operation range from among the above-mentioned divided operation ranges. Further, this engine operation-range variation may vary an air-fuel ratio shift due to prolonged passage of time. This variation in air-fuel ratio occurs because an amount of such a kind of air-fuel ratio shift (time-passage shift) depends on the range, from among the above-mentioned divided operation ranges, in which the engine currently operates. A cause of such a variation of FAF due to such changes in the engine operation condition causing variation in time-passing shift will be hereinafter referred to "operation-range variation time-passage shift".

By the above-mentioned averaging, the curve of FAFSM shown in FIG. 5A has a gentle slope accordingly, as shown in FIG. 5A.

On the other hand, FAFAV is obtained by averaging FAF over a relatively short time period. Thus, while FAF varies due to such an "operation-range variation time-passage shift", FAFAV then varies due to the "operation-range variation time-passage shift". Thus, the curve of FAFSM shown in FIG. 5A varies violently, accordingly, as shown in FIG. 5A. Thus, FAFAV is affected by not only effects of the purging by means of the purging system A4 but also by "operation-range variation time-passage shift".

With reference to the time range between $t_2$ and $t_3$ of FIG. 5A, the range referred to as D corresponds to an air-fuel ratio shift-amount due to such an "operation-range variation time-passage shift". The range D corresponds to a difference between FAFSM and FAFAV at a time in the above time range. The range referred to as E corresponds to an air-fuel ratio shift-amount approximately constant without relation to "operation-range variation time-passage shift". The range E corresponds to a difference between FAFSM and 1.0 at a time before the time $t_1$.

To appropriately utilize such various air-fuel ratio-shifts as mentioned above in updating the learning values, the following process is needed. Here, appropriately updating the learning values results in efficient or optimum air-fuel ratio control operation. It is necessary that these various kinds of air-fuel ratio-shifts be obtained as corresponding separate amounts. Then, corresponding learning values KGi, and KGj are updated respectively using the obtained air-fuel ratio shift-amounts. Thus, the KGi and KGj are used to achieve an efficient or optimum air-fuel ratio control operation.

Following will be described the manner in which the learning values KGj are to be obtained, which KGj correspond to air-fuel ratio-shifts due to "operation-range variation time-passage shift". The description will now be given only corresponding to the time range between $t_2$ and $t_3$. In this time range, FAFSM has a certain value, and a difference between this value and the value 1.0 is the amount F, as shown in FIG. 5A. FAFAV has a certain value, and a difference between this value and the value 1.0 is about the amount G, as shown in FIG. 5A.

FAFSM has a value which includes only an amount associated with effect of the evaporated fuel purging. The value of FAFSM does not include an amount associated with effects of "operation-range variation time-passage shift". This is because such effects of "operation-range variation time-passage shift" are eliminated in FAFSM by averaging the relevant FAF over a relatively long time period. Each FAFAV has a value which includes both an amount associated with effects of the evaporated-fuel purging and an amount associated with the effect of the "operation-range variation time-passage shift". This is because such effects of "operation-range variation time-passage shift" are not eliminated in FAFAV as averaging relevant FAF is conducted over a relatively short time period. Thus, the difference between FAFSM and FAFAV, that is, the amount D shown in FIG. 5A, which corresponds also to the difference between the amount F and the amount G, corresponds to the effect due to "operation-range variation time-passage shift". Thus, this amount G will be utilized to update learning values KGj such as mentioned above. These learning values KGj correspond to air-fuel ratio-shifts due to "operation-range variation time-passage shift".

A learning control routine to update learning values KGj such as mentioned above will be described with reference to FIG. 6. Before the description concerning FIG. 6, An operation routine to determine FAFSM and FAFAV will now be described with reference to FIG. 7. In the description, the term "step" will be omitted so that, for example, "a step S10" will be expressed as simply "S10", hereinafter.

In S10, FAFSM is determined. A new FAFSM will be determined, that is, FAFSM will be updated, using the following equation (6):

$$FAFSM = FAFSM + (FAF - FAFSM)/N \quad (6).$$

In the equation (6), two FAFSM values, which are located at the right side, respectively correspond to the value determined in the preceding routine. The value FAF represents a current feed-back correction factor such as mentioned above. The value N represents a constant used to make FAFSM smooth. FAF is obtained as a result of calculation by means of the CPU 34, which FAF is determined by a feed-back correction factor determination routine not shown.

There may be a condition wherein FAF used in the equation (6) is obtained associated with this condition. This condition is a condition in the engine 10, where the purge control value 27 is opened and thus 10 vapor is purged from the canister 21 into the surge tank 15. This condition will hereinafter be referred to as "purge condition". In this condition, a fuel density of the current intake-air quantity increases and the air-fuel ratio is thus reduced. Then, FAF is determined as a reduced value so that the reduced air-fuel ratio is corrected to be the original air-fuel ratio which was before the reduction of the air-fuel ratio as mentioned above. That is, FAF becomes a value so as to reflect the effects of the purging. Further, the value of FAF also reflects effects of "operation-range variation time-passage shift". Such as described above, the operation ranges are previously defined by partitioning the engine operation range and this definition being executed so that the plurality of operation ranges correspond to various intake-air pressures PW which are detected by means of the intake-air pressure sensor 17.

As shown in the equation (6), the current FAFSM is obtained as a result of: subtracting the preceding FAFSM by the current FAF, the result of subtraction being divided by the smoothing constant N, and the result of the division then being added to the preceding FAFSM. That is, each FAFSM is obtained by averaging FAF over a relatively long time period. Thus, if FAF may vary due to "operation-range variation time-passage shift", effects of this variation will not affect a value of FAFSM.

FAFAV is determined in S12 using the following equation (7):

$$FAFAV = (FAF_0 + FAF)/2 \quad (7).$$

In the equation (7), $FAF_0$ is a preceding feed-back correction factor obtained by execution of the preceding feed-back correction factor determination routine. $FAF_0$ is a current feed-back correction factor obtained by execution of the current feed-back correction factor determination routine. Thus, in S12, the preceding and current feed-back correction factors are averaged. Thus, FAFAV is obtained by averaging FAF over a relatively short time period in comparison to the manner in the procedure for obtaining FAFSM.

There may be a condition wherein FAF used in the equation (7) is obtained associated with this condition, the condition being a purge condition such as mentioned above. In this condition, FAF has a value reflecting the effects of the purging. Further, the value of FAF also reflects the effects of "operation-range variation time-passage shift". As FAFAV is obtained by the equation (7) as mentioned above, FAFAV has a value greatly reflecting both effects due to the purging and effects due to "operation-range variation time-passage shift". This is a point of difference between the FAFAV and the FAFSM.

Thus, as shown in FIG. 5A, FAFAV as well as FAFSM represent characteristics corresponding to evaporated-fuel purging. However, FAFAV represents characteristics corresponding to "operation-range variation time-passage shift", more clearly in comparison to corresponding representation in FAFSM.

An operation flow of a learning control routine will now be described with reference to FIG. 6. This learning control routine is executed by the electronic control unit 30 using the obtained FAFSM and FAFAV.

Figure 6:
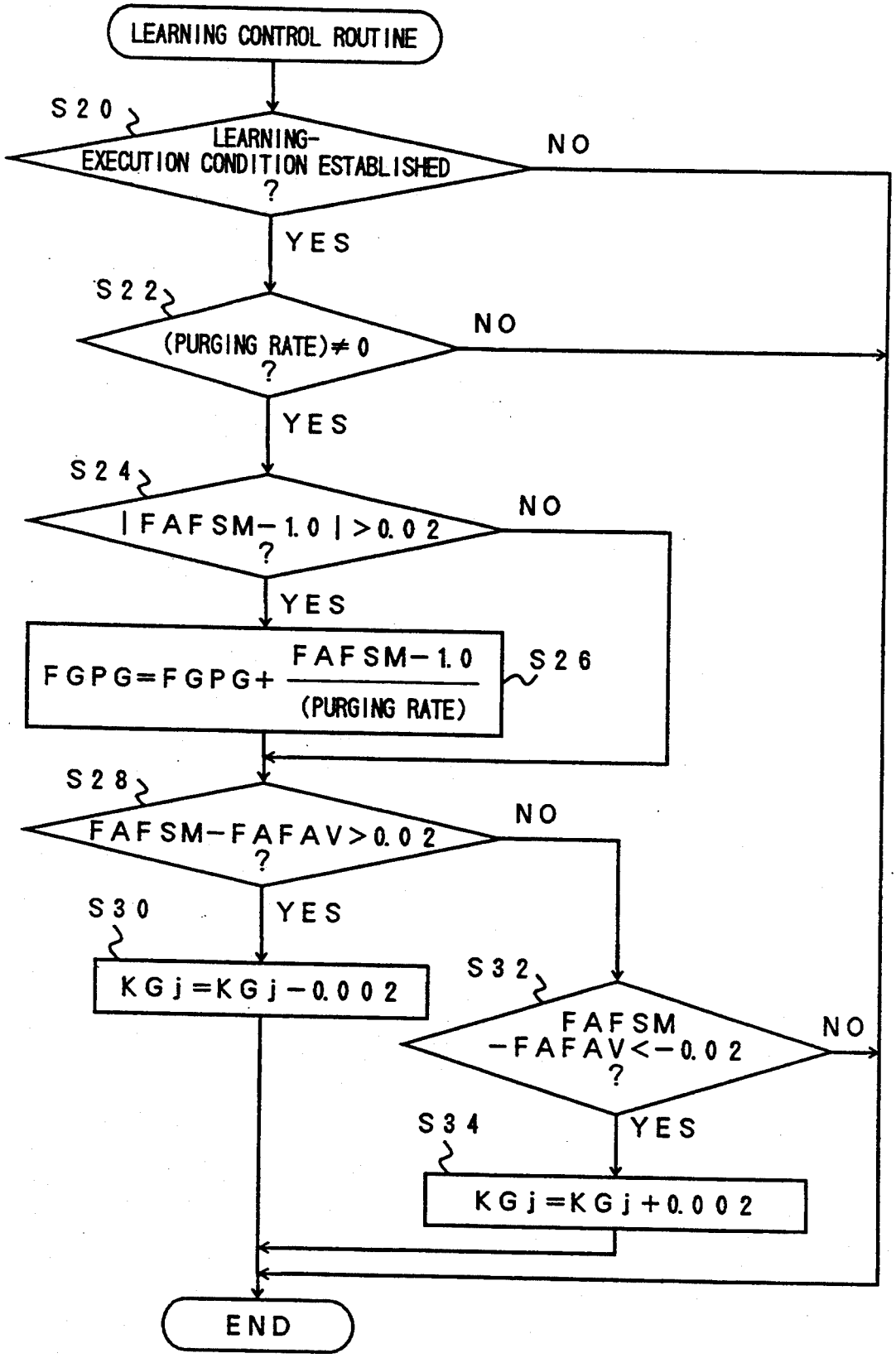
FIG. 6 shows an operation flow of a learning control routine in which learning values are obtained for the air-fuel ratio-shifts respectively occurring in the engine-condition ranges.

When the process shown in FIG. 6 is initiated it is determined, in S20, whether or not a learning execution condition has been established. This learning execution condition may include, for example, a condition where an air-fuel ratio feed-back control is being executed. The learning execution condition may further include a condition where an air to fuel ratio sensor 41 is in its normal operation condition. If this learning execution condition has not been established, the current cycle of the routine will not be executed and thus the current cycle will be finished.

If it is determined that the learning execution condition has been established in S20, S22 is executed. In S22, it is determined whether or not a current purging rate is zero. This determination is executed by, for example, determining whether or not the purge control valve 27 in the evaporated-fuel purging system 22 is open. There may be a case where it is determined that the current purging rate is zero. That is, the system is in a condition where no evaporated-fuel purging is being executed and thus it is not needed to execute updating, associated with the purging, of the learning values. In this case, a learning control process, which process corresponds to steps starting from S24 and which process is to be executed when the purging being executed, is not executed, the current cycle thus be finishing.

When it is determined in S22 that the current purging rage is not zero, that is, that the purging is being executed, S24 is executed. In S24, it is determined whether or not an absolute value of (FAFSM-1.0) exceeds a predetermined value, for example, the value 0.02. As shown in FIG. 5A, FAFSM may vary with respect to the value 1.0.

In S22, if it is determined that the absolute value of (FAFSM-1.0) exceeds 0.02, that is, a variation range of FAFSM exceeds the predetermined value, S26 is executed. In S26, a current purged-fuel density factor FGPG is obtained, which FGPG is an amount per each purging-rate unit. The FGPG is obtained using the following equation (8):

$$FGPG=FGPG+(FAFSM-1.0)/(\text{purging rate}) \quad (8).$$

Figure 7:
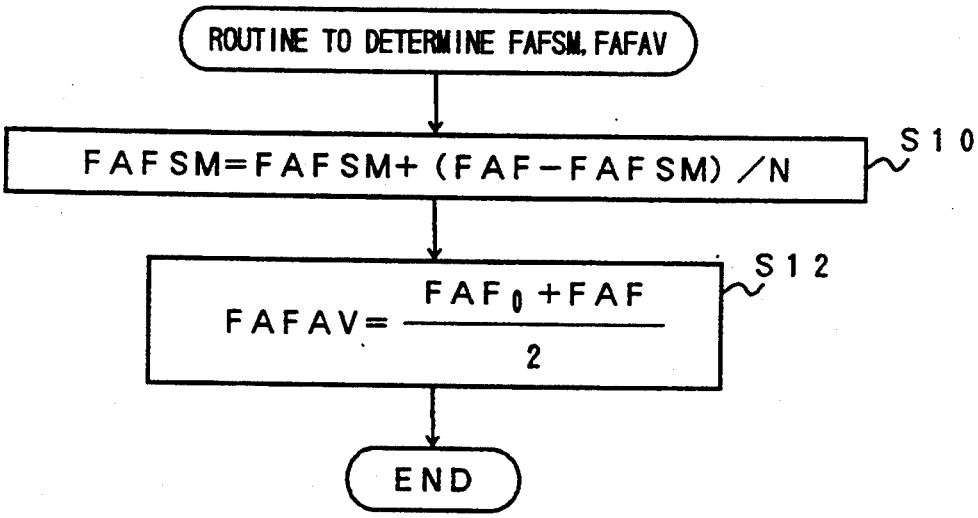
FIG. 7 shows an operation flow of a routine for determining FAFSM and FAFAV.

In the equation (8), FGPG in the right side represents the amount obtained by a preceding learning control routine. FAFSM represents the current amount obtained by a current FAFAV determination routine such as shown in FIG. 7. The purging rate in the equation (8) is a ratio of a current purging quantity to a current intake-air quantity. The current purging quantity is determined as an opening rate of the purge control valve 27 while the current intake-air quantity is read from output of the intake-air pressure sensor 17.

The process in S24 is executed prior to and as a condition to be established before the updating FGPG. This is in order to prevent an irrelevant external factor from affecting FGPG. Such an irrelevant external factor may be included in FAFSM.

Thus, by the process in S24 and S26, variation in FAFSM is reflected appropriately in FGPG. Thus, FGPG obtained using the equation (8) has an amount reflecting a purging condition in the evaporated-fuel purging system 22. FGPG is used to obtain a purge correction factor FPG as mentioned below. Thus, FPG also reflects a purging condition in the evaporated-fuel purging system 22.

In S28, (FAFSM−FAFAV) is obtained. The meaning of (FAFSM−FAFAV) will now be described with reference to FIG. 5A. Similarly to the above description concerning FIG. 5A, the time period between $t_2$ and $t_3$ will be used, for example, in the description. As mentioned above, in this time period, the difference between FAFSM and 1.0 is F while the difference between FAFAV and 1.0 is almost G. As mentioned above, obtaining the difference between FAFSM and FAFAV can cancel effects of the evaporated-fuel purging. As a result of obtaining the difference, the amount D shown in FIG. 5A will be obtained. The amount D thus only reflects effects of "operation-range variation time-passage shift". Thus, in the embodiment according to the present invention, an operation of (FAFSM−FAFAV) can cancel effects of the evaporated-fuel purging. Thus, even while the evaporated-fuel purging operation is being executed, an appropriate updating of the learning values KGj concerning the "operation-range variation time-passage shift" is performed.

Thus, (FAFSM−FAFAV) may be used directly as a current learning value KGj associated with the current operation range of the engine operation condition. However, in this embodiment, the value (FAFSM−FAFAV) is used for updating the learning value KGj. This updating is executed in steps S28 to S34 as follows.

In S28, it is determined whether or not (FAFSM-FAFAV) exceeds a predetermined value, for example, 0.02. If it is determined that (FAFSM−FAFAV) exceeds 0.02, S30 of FIG. 6 is executed. In S30 of FIG. 6, the learning value KGj is updated using the following equation (9):

$$KGj=KGj-0.002 \quad (9).$$

By the equation (9), the learning value KGj corresponding to a current operation range of the engine operation condition is obtained.

On the other hand, if it is determined that (FAFSM−FAFAV) does not exceed 0.02, S32 of FIG. 6 is executed. In S32 of FIG. 6, it is determined whether or not (FAFSM−FAFAV) has a value less than a predetermined value, for example, −0.02. If it is determined that (FAFSM−FAFAV) has a value less than −0.02, S34 will now be executed. In S34, the learning value KGj is updated by the following equation (10):

$$KGj=KGj+0.002 \quad (10).$$

If it is determined that (FAFSM−FAFAV) does not have a value less than −0.02, the current cycle is finished without updating the preceding learning value KGj.

Figure 8:
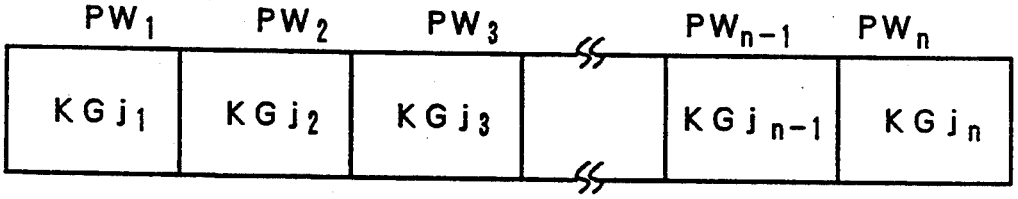
FIG. 8 shows a diagram of areas to store the learning values.

In the equations (9) and (10), KGj in the right sides is respectively the preceding learning value KGj determined in the preceding updating operation. Learning values KGj (KGjn) such as mentioned above are respectively stored in a plurality of storing areas as shown in FIG. 8. These plurality of storing areas are defined so that these storing areas respectively correspond to various intake-air pressures PWn. The above-mentioned updating process is executed for each area shown in FIG. 8. In an example for one of these updating processes, there may be a case where the current intake-air pressure PW is in an area corresponding to $PW_3$ of FIG. 8 while a learning control routine such as shown in FIG. 6 is being executed. In this case, the corresponding learning value $KGj_3$ stored in the area $PW_3$ is updated accordingly.

Summarizing the steps S28 to S34, the following processes are executed for the following three cases (I) to (III):

(I) If FAFSM−FAFAV>0.02, then the learning value KGj is updated to be (KGj−0.02).

(II) If FAFSM−FAFAV<−0.02, then the learning value KGj is updated to be (KGj+0.02).

(III) If $-0.02 \leqq FAFSM-FAFAV < 0.02$, then the learning value KGj is not updated.

A reason why if $-0.02 \leqq FAFSM-FAFAV \leqq 0.02$, the learning value KGj is not updated will now be described. Variation of (FAFSM−FAFAV) within the above range $-0.02 \leqq FAFSM-FAFAV \leqq 0.02$ can be approximately determined as resulting from irrelevant factors. Such irrelevant external factors affecting the learning values KGj may result in a degraded air-fuel ratio control operation being executed. Thus, the measure corresponding to the process in the case (III) enables a more accurate control eliminating effect of such irrelevant external factors.

Furthermore, in the embodiment according to the present invention, as in the processes in the above mentioned cases (I) and (II), the learning value KGj is updated so that only a small value such as 0.002 is differentiated from the preceding value in the updating. Thus, the KGj vary gently.

Such gentle variation of the learning value KGj enables a stable engine operation condition while the learning value is updated. If a learning value were updated so that the value varied in proportion to a possible large change of (FAFSM−FAFAV), such updating might have undesired influence on the engine operation condition. Thus, in the embodiment according to the present invention, a stable engine operation condition may be maintained even while the evaporated-fuel purging operation is being executed. Further, as mentioned above, effects of the purging are canceled by the operation of (FAFSM−FAFAV) executed in S28. Thus, the learning value KGj can be updated even while the purging operation is being executed. That is, it is not necessary to stop the purging operation so as to update the learning value KGj. Thus, the problem occurring due to shortage of purging can be overcome.

Figure 10:
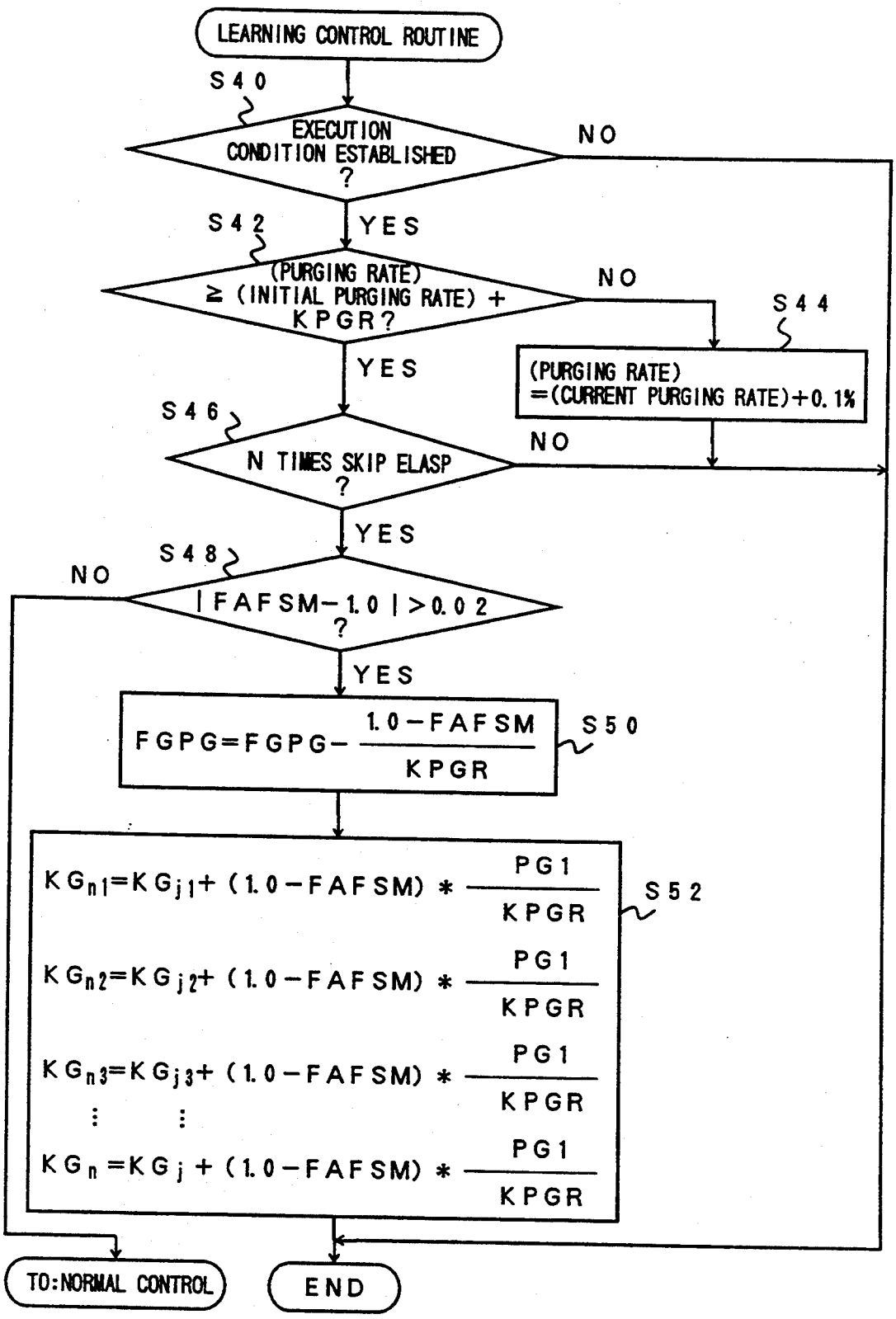
FIG. 10 shows an operation flow of a learning control routine in which learning values are obtained for the air-fuel ratio-shifts respectively occurring due to the prolonged passage of time.

How a learning value KGi such as mentioned above is obtained will now be described with reference to FIG. 10. The learning value KGi corresponds to an air-fuel ratio-shift which is relatively constant without regard to variation in the engine operation conditions. FIG. 10 shows an operation flow of a learning control routine to determine the learning value KGi.

Figure 9:
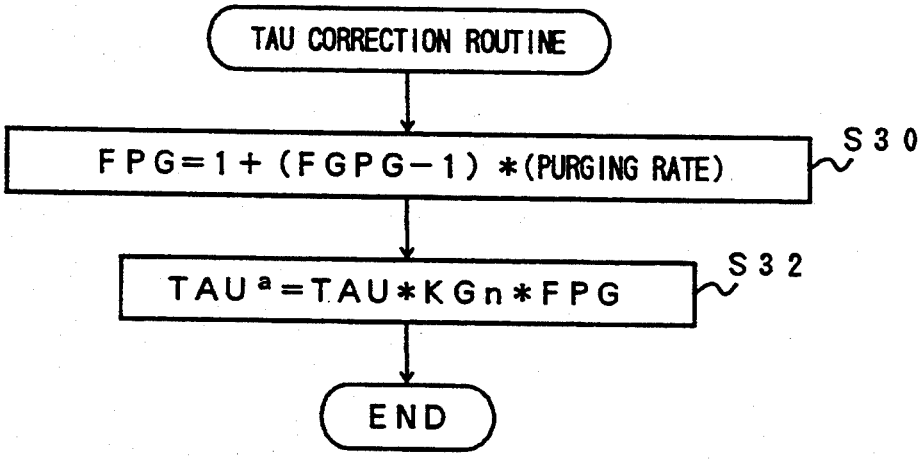
FIG. 9 shows an operation flow of a routine for correcting TAU.

Before the routine shown in FIG. 10 is started, the air-fuel ratio control is carried out based on a supposition that no time-passage shift such as mentioned above exists, by reflecting the supposition on a relevant learning value KGn in an equation of a step S32 in FIG. 9. This air-fuel ratio control is carried out so as to correct a purge shift such as mentioned above. That is, this air-fuel ratio control is carried out based on a supposition that a vapor density such as mentioned above is the false vapor density characteristic shown as the break line F of FIG. 3.

Thus, if the above-mentioned supposition were true, no air-fuel ratio shift should occur under the above-mentioned air-fuel ratio control while the purging rate is PG2. However, this supposition is not true and there exists a time-passage shift corresponding to the value R4 shown in FIG. 3. That is, the actual vapor density characteristic is represented as the true vapor density shown as the chain line T of FIG. 3. Thus, an air-fuel ratio shift corresponding to the amount δR occurs under the above-mentioned air-fuel ratio control. Thus, δR is obtained by measuring the actual air-fuel ratio shift-amount by means of the air to fuel ratio sensor 41. An air-fuel ratio shift-amount corresponds to a value (1-FAFSM) as mentioned above. Thus, δR may be represented by (1.0-FAFSM) as described below with regard to a step S52.

When, a process shown in FIG. 10 is initiated, it is determined in S40 whether or not a learning execution condition has been established. (This initiation of the process shown in FIG. 10 may be, for example, executed periodically at a desired intervals.) This learning execution condition may include, for example, a condition where an air-fuel ratio feed-back control is being executed. The learning execution condition may further include a condition where an air to fuel ratio sensor 41 is in its normal operation condition. The learning execution condition may further include a condition where a purging rate is stable and is a predetermined value. This predetermined purging rate will be referred to as "initial purging rate" hereinafter. This initial purging rate corresponds to PG1 in FIG. 3. If this learning execution condition has not been established, the current cycle of the routine starting from S43 will not be executed and thus the current cycle will end.

If it is determined that the learning execution condition has been established in S40, S42 is executed. In S42, it is determined whether or not a current purging rate is equal to or greater than a value resulting from adding KPGR to the initial purging rate. The KPGR is a value (PG2−PG1) as shown in FIG. 3. If (it is determined negatively in S42, that is,) the current purging rate is less than the value resulting from adding KPGR to the initial purging rate, then S44 is executed. In S44, a predetermined value, for example, 0.1%, is added to the current purging rate. Then, the result of this adding becomes a new purging rate. By executing steps S42 and S44, PG1 is revised to PG2. Further, the electronic control unit 30 executes the routine, shown in FIG. 7, is used to determine FAFSM and FAFAV. This operation by means of the electronic control unit 30 is executed for each purging rate of successively varying purging rates starting from the original purging rate PG1 up to the new purging rate PG2. As described below, in the learning control routine in shown in FIG. 10, only FAFSM is used to determine the learning value.

After the purging rate has been completely revised from PG1 to PG2, if it is determined in S42 that the current purging rate is equal to or greater than the value resulting from adding KPGR to the initial purging rate, then S46 is executed. In S46, an n-times skip process (where n is a predetermined integer) is executed. This skip process in S46 is needed to wait for values FAFSM and FAFAV to become stable. FAFSM and FAFAV are determined by operation by the determination routine as mentioned above.

After the skip process in S46 has been completed, S48 is started. In S48, it is determined whether or not an absolute value of a value resulting from subtracting 1.0 from FAFSM exceeds a predetermined value (in this embodiment, it is 0.02). This FAFSM corresponds to the new purging rate PG2 and it has been obtained by the determination routine for FAFSM and FAFAV as mentioned above. Thus, this FAFSM corresponds to the current air-fuel ratio shift-amount, as mentioned above. There may be a case where it is determined in S48 that the absolute value of the value resulting from subtracting 1.0 from FAFSM does not exceed 0.02. In this case, it is then determined that the current air-fuel ratio-shift is too small to affect the air-fuel ratio control operation. Thus, the normal learning control operation (shown in FIG. 6) is started without executing the learning-value updating process starting from S50.

There may be another case where it is determined in S48 that the absolute value of the value resulting from subtracting 1.0 from FAFSM exceeds 0.02. In this case, it is then determined that the current air-fuel ratio-shift is large enough to affect the air-fuel ratio control operation. Then, S50 is executed accordingly. Then, FGPG is determined by the following equation (11), which FGPG is a purge fuel density factor per each purging-rate unit:

$$FGPG = FGPG - (1.0\text{-}FAFSM)/KPGR \quad (11).$$

In the equation (11), FGPG in the right side represents FGPG while the purging rate is the initial purging rate PG1 and FAFSM represents FAFSM while the purging rate is the new purging rate PG2.

After FGPG is obtained in S50, then S52 is executed accordingly. Then, the above-mentioned and also described-below equation (5) is used:

$$R4 = \delta R * PG1/KPGR \quad (5).$$

δR in this equation (5) may be replaced by the term (1.0-FAFSM). Thus, the equation (5) may be revised to the following equation (12):

$$R4=(1.0-FAFSM)*PG1/KPGR \quad (12).$$

As mentioned above, R4 corresponds to an amount of an air-fuel ratio-shift resulting from a characteristics-variation due to the prolonged passage of time. Thus, the value R4 may be used as a learning value KGi. Thus, the equation (12) is revised to the following equation (13):

$$KGi=(1.0-FAFSM)*PG1/KPGR \quad (13).$$

The obtained learning value KGi is used to determine a basic fuel-injection quantity TAU in a process to determine the fuel-injection quantity. Thus, an appropriate air-fuel ratio control is enabled, which control reflects an air-fuel ratio-shift resulting from a characteristics-variation due to the prolonged passage of time such as mentioned above. The learning value KGi can be obtained, as mentioned above, by varying the purging rate. Thus, it is not necessary to stop the purging to obtain the learning value KGi. Thus the problem caused by the shortage of purging can be overcome.

To make the fuel-injection quantity control reflect the above mentioned learning value KGi, the following method may be allowed in the scope of the present invention. In an example of achieving the above-mentioned method, in the process of determining a fuel-injection quantity, the fuel-injection quantity $TAU^a$ may be obtained by the equation (14) below. In the equation (14), the learning values KGj obtained by the learning control routine shown in FIG. 6 are also used.

$$TAU^a=TAU*(KGj+KGi)*FPG \quad (14).$$

In the equation (14), FPG represents a purge correction factor obtained based on FGPG. TAU represents the fuel-injection quantity resulting from other corrections being performed thereon. These other corrections may include a warming-up increasing correction and acceleration increasing correction.

In this embodiment according to the present invention, general learning value KGn is obtained as a result of adding the learning value KGi respectively to the learning values KGj. The learning values KGj are obtained for the operation ranges of the engine operation condition, as mentioned above, while the learning value KGi corresponds to the above-mentioned time-passage shift. Then, these learning values KGn are respectively stored for the operation ranges. Thus, the general learning values KGn is represented by the following equation (15):

$$\begin{aligned} KGn &= KGj + KGi \\ &= KGj + (1.0 - FAFSM)*PG1/KPGR. \end{aligned} \quad (15)$$

By a TAU correction routine shown in FIG. 9, the fuel-injection quantity TAU is corrected using the general learning values KGn and the above-mentioned purge correction factor FPG. In S30 of FIG. 9, the equation (16) described below is used to obtain the purge correction factor FPG. The calculation associated with the equation (16) uses FGPG obtained by S26 shown in FIG. 6 or S50 shown in FIG. 10 as mentioned above.

$$FPG=1+(FGPG-1)*(\text{purging rate}) \quad (16).$$

In the next S32 of FIG. 9, the fuel-injection quantity TAU, resulting from the above-mentioned other corrections being performed thereon, is corrected. These other corrections may include a so-called warming-up increasing correction and so-called acceleration increasing correction, as mentioned above. This correction in S32 of FIG. 9 uses the above-mentioned general learning values KGn and the above-mentioned purge correction factor FPG. As a result, $TAU^a$, which is used to drive the fuel-injection valve 14, is obtained. The general learning values KGn used in S32 of FIG. 9 have not been affected by evaporated fuel purging by means of the purging system 22, as mentioned above. However, the KGn only reflect effects desired to represent, which effects include, for example, an air-fuel ratio-shift due to the prolonged passage of time, that is, effects due to the above-mentioned time-passage shift. Thus, such effects including effects due to the time-passage shift is learned by determining optimum learning values and then using the values in the air-fuel ratio control operation. Thus, an optimum air-fuel ratio is always maintained without regard to such effects including those due to the time-passage shift.

The values such as 0.02, or 0.002 used in the above-mentioned embodiment according to the present invention are shown only as examples, and the values are not limited to these example amounts.

Furthermore, in the engine of the embodiment, the intake-air pressure sensor is used to obtain an intake-air quantity and the output of the sensor is used to determine a corresponding intake-air quantity. (The intake-air quantity may be obtained by both a relevant intake-air pressure and engine rotation speed.)

However, the present invention may be applied to an internal engine using other means of measuring an intake-air quantity. The other means may be, for example, an air flow meter or a Karman vortices air flow meter.

Another method may be used in the present invention to reflect a learning value such as KGi on a fuel-injection quantity control, for example a method wherein KGi and KGj are respectively stored in B-RAM 46 separately. KGj and KGi may then be respectively reflected on TAU separately in an operation process to determine a fuel-injection quantity.

By the present invention, effects due to a purge shift and effects due to a time-passage shift, such as mentioned above, can be separated from each other. This separation is executed by obtaining values corresponding to air-fuel ratio-shifts occurring in different purging rates in the engine. Thus, effects due to the purge shift may be eliminated from a learning value and thus an appropriate learning value may be obtained which value only reflects the time-passage shift effect. Furthermore, by the present invention, it is enabled to obtain or update the learning value while an evaporated-fuel purging operation is being executed. Thus, sufficient purging is ensured and an accurate learning is enabled.

Further, the present invention is not limited to the above described embodiments, and variations and modifications may be made without departing from the scope of the present invention.

What is claimed is:

1. An air-fuel ratio control system for an internal combustion engine, wherein the engine includes an evaporative fuel purge system including a canister for temporarily storing fuel vapor, the air-fuel ratio control system comprising:

air to fuel ratio detecting means for detecting an air-fuel ratio in exhaust gas discharged from the engine;

air-fuel ratio control means for controlling the air-fuel ratio in exhaust gas from the engine by varying a fuel quantity supplied to the engine so that the air-fuel ratio approaches a predetermined target air-fuel ratio;

wherein the evaporative fuel purge system includes purging means for purging evaporated fuel from the canister to the engine, the purging being executed at a purging rate determined by the purging means;

air-fuel ratio-shift correction means for optimizing the air-fuel ratio control by deriving a first component of a detected air-fuel ratio-shift amount, which first component is an amount by which the air-fuel ratio has shifted from the target air-fuel ratio due to a cause independent of the purging executed by the purging means, wherein the first component is relatively constant over time in comparison to a second component of the detected air-fuel ratio shift amount occurring as a result of the purging operation executed by said purging means; and wherein the air-fuel ratio-shift correction means derives the first component based on a first detected air-fuel ratio-shift amount and a second detected air-fuel ratio-shift amount, wherein the first detected air-fuel ratio-shift amount is detected by the air to fuel ratio detecting means when the purging means is purging at a first purging rate and wherein the second air-fuel ratio-shift amount is detected by the air to fuel ratio detecting means when the purging means is purging at a second purging rate different from the first purging rate.

2. The air-fuel ratio control system according to claim 1, wherein:

the air-fuel ratio controlling means controls the air-fuel ratio based on a plurality of air-fuel ratio correction factors derived from the air-fuel ratio detected by the air to fuel ratio detection means; and the air-fuel ratio controlling means further derives average air-fuel ratio correction factors by averaging the values of the air-fuel ratio correction factor derived at predetermined time intervals; and wherein the air-fuel ratio-shift correction means derives the first component of the detected air-fuel ratio-shift amount using a first average air-fuel ratio correction factor derived when the purging means is purging at a first purging rate and a second average air-fuel ratio correction factor derived when the purging means purges at a second purging rate.

3. The air-fuel ratio controlling system according to claim 1, wherein the first component, R4 is obtained using the following equation:

$$R4=\delta R*PG1/(PG2-PG1);$$

wherein PG1 is the first purging rate while PG2 is the second purging rate and R2 is wherein δR is obtained by the following equation:

$$\delta R=R2-R3;$$

wherein R3 is the air-fuel ratio shift-amount at the second purging rate and R2 is obtained using the following equation:

$$R2=R1*PG2/PG1;$$

and wherein R1 is the air-fuel ratio shift-amount at the first purging rate.

4. The air-fuel ratio controlling system according to claim 2, wherein the first component, R4 is obtained by the following equation:

$$R4=\delta R*PG1/(PG2-PG1);$$

wherein PG1 is the first purging rate while PG2 is the second purging rate and, wherein δR is obtained by the following equation:

$$\delta R=R2-R3;$$

wherein R3 is the average air-fuel ratio correction factor and R2 obtained using the following equation:

$$R2=R1*PG2/PG1;$$

and wherein R1 is the first air-fuel ratio correction factor.

5. The air-fuel ratio controlling system according to claim 1, wherein the first component, R4 is obtained by the following equation:

$$R4=\delta R*PG1/(PG2-PG1);$$

wherein PG1 is the first purging rate while PG2 is the second purging rate and, wherein δR is obtained as an air-fuel ratio shift-amount between the target air-fuel ratio and an air-fuel ratio which is detected by the air to fuel ratio detecting means while the air-fuel ratio control means controls the air-fuel ratio based on a supposition that the first component is equal to zero.

6. The air-fuel ratio controlling system according to claim 2, wherein the first component, R4 is obtained by the following equation:

$$R4=\delta R*PG1/(PG2-PG1);$$

wherein PG1 is the first purging rate while PG2 is the second purging rate and, wherein δR is obtained as an air-fuel ratio shift-amount between the target air-fuel ratio and an air-fuel ratio which is detected by the air to fuel ratio detecting means while the air-fuel ratio control means controls the air-fuel ratio based on a supposition that the first component is equal to zero.

7. The air -fuel ratio controlling system according to claim 1, wherein the air-fuel ratio is a weight ratio of air to fuel, which air and fuel are fed into the internal combustion engine, and wherein the purging rate is a volume ratio of a gas quantity being purged, to an intake-air quantity being taken into the internal combustion engine when the evaporated fuel quantity is purged from the canister.

8. The air-fuel ratio controlling system according to claim 1, wherein first component is caused by variation in a part employed in the internal combustion engine, the variation being caused due to the prolonged passage of time.

9. The air -fuel ratio controlling system according to claim 8, wherein the part employed in the internal combustion engine is the air to fuel ratio detecting means.

10. The air-fuel ratio controlling system according to claim 1, wherein the air-fuel ratio-shift correction means employs the current relatively-constant air-fuel ratio shift-amount as a learning value.

11. An air-fuel ratio control system for an internal combustion engine, wherein the engine includes an evaporative fuel purge system including a canister for temporarily storing fuel vapor, the air-fuel ratio control system comprising:

air to fuel ratio detecting means for detecting an air-fuel ratio in exhaust gas discharged from the engine;

air-fuel ratio control means for controlling the air-fuel ratio in exhaust gas from the engine by varying a fuel quantity supplied to the engine so that the air-fuel ratio approaches a predetermined target air-fuel ratio;

wherein the evaporative fuel purge system includes purging means for purging evaporated fuel from the canister to the engine, the purging being executed at a purging rate determined by the purging means;

air-fuel ratio-shift correction means for obtaining a difference between a long term correction factor and a short term correction factor, the long term correction factor being obtained by averaging detected air-fuel ratios over a first time period while the short term correction factor is obtained by averaging detected air-fuel ratios over a second time period, wherein the first time period is substantially longer than the second time period, wherein the air-fuel ratio shift correction means uses the difference between the long term correction factor and the short term correction factor to optimize the air-fuel ratio control executed by the air-fuel ratio control means.

12. The air fuel ratio controlling system according to claim 11, wherein:

the long term correction factor FAFSM is updated periodically according to the following equation:

$$FAFSM = FAFSM_1 + (FAF - FAFSM_1)/N;$$

wherein $FAFSM_1$ is the preceding value of FAFSM, FAF is the currently detected air-fuel ratio, and N is a predetermined constant;

the short term correction factor FAFAV is updated periodically according to the following equation:

$$FAFAV = (FAF_0 + FAF)/2;$$

wherein $FAF_0$ is a previously detected air-fuel ratio and FAF corresponds to the currently detected air-fuel ratio; and wherein the air-fuel ratio correction means employs the difference between the long term correction factor and the short term correction factor as a learning value, and wherein the learning value is updated periodically by subtracting a first predetermined updating value from the preceding learning value when the difference between the long term correction factor and the short term correction factor exceeds a first predetermined threshold value, and by adding a second predetermined updating value to the preceding learning value when the difference between the long term correction factor and the short term correction factor is less than a second predetermined threshold value, the second predetermined threshold value being less than the first predetermined threshold value.

13. The air-fuel ratio controlling system according to claim 12, wherein the air-fuel ratio correction means employs a plurality of learning values, each learning value corresponding to a respective intake-air pressure range, wherein each learning value is updated when the current intake-air pressure is within its respective intake-air pressure range.

* * * * *

UNITED STATES PATENT AND TRADEMARK OFFICE
CERTIFICATE OF CORRECTION

PATENT NO. : 5,423,307

DATED : June 13, 1995

INVENTOR(S) : Koji OKAWA et al.

It is certified that error appears in the above-identified patent and that said Letters Patent is hereby corrected as shown below:

ON THE TITLE PAGE, after the filing date, insert

--[30] Foreign Application Priority Data

July 1, 1992 [JP] Japan ..... 4-174524--.

| Column | Line | |
|---|---|---|
| 1 | 26 | After "engine" delete "that". |
| 1 | 65 | Change "value" to --values--. |
| 2 | 31 | Change "needed" to --necessary--. |
| 2 | 62 | Change "to" to --on--. |
| 5 | 3 | After "first" insert --and--. |
| 5 | 41 | Change "to" to --with--. |
| 7 | 20 | Change "A6" to --6--. |

UNITED STATES PATENT AND TRADEMARK OFFICE

CERTIFICATE OF CORRECTION

PATENT NO. : 5,423,307

DATED : June 13, 1995

INVENTOR(S) : Koji OKAWA et al.

It is certified that error appears in the above-identified patent and that said Letters Patent is hereby corrected as shown below:

| Column | Line | |
|---|---|---|
| 7 | 55 | Change "or A6" to --and 6--. |
| 7 | 56 | Change "in" to --at--. |
| 8 | 3 | After "is" insert --an--. |
| 8 | 4 | After "value" insert --of--; after "FAFSM" insert --obtained-- |
| 8 | 5 | Change "correspondingly" to --correspond-ing--; after "rate" delete "is". |
| 8 | 6 | Delete "in". |
| 8 | 10 | After "The" insert --value--. |
| 8 | 24 | Change "Here:" to --Here,--. |
| 9 | 61 | Change "conduit 27" to --conduit 24--. |

UNITED STATES PATENT AND TRADEMARK OFFICE

CERTIFICATE OF CORRECTION

PATENT NO. : 5,423,307

DATED : June 13, 1995

INVENTOR(S) : Koji OKAWA et al.

It is certified that error appears in the above-identified patent and that said Letters Patent is hereby corrected as shown below:

| Column | Line | |
|---|---|---|
| 10 | 1 | Change "30" to --20--. |
| 11 | 9 | Change "passage prolonged time" to --prolonged passage of time--. |
| 11 | 42 | Change "doe" to --due--. |
| 11 | 63 | Delete "This mentioned certain" and insert --These--. |
| 11 | 64 | Change "causes" to --cause--. |
| 13 | 38 | Change "value" to --valve--; delete "10". |
| 14 | 60 | After "purging" insert --is--. |
| 14 | 61 | Delete entire line and insert --and thus the current cycle ends.--. |

UNITED STATES PATENT AND TRADEMARK OFFICE
CERTIFICATE OF CORRECTION

PATENT NO. : 5,423,307

DATED : June 13, 1995

INVENTOR(S) : Koji OKAWA et al.

It is certified that error appears in the above-identified patent and that said Letters Patent is hereby corrected as shown below:

| Column | Line | |
|---|---|---|
| 14 | 63 | Change "rage" to --rate--. |
| 17 | 49 | After "at" delete "a". |
| 18 | 8 | Delete "is". |
| 18 | 25 | After "operation" change "by" to --of--. |
| 20 | 14 | Before "KGn" insert --general learning values--. |
| 20 | 14-15 | Change "represent" to --to be represented--. |
| 20 | 19 | Change "is" to --are--. |

Signed and Sealed this

Fourteenth Day of May, 1996

*Attest:*

BRUCE LEHMAN

*Attesting Officer*

*Commissioner of Patents and Trademarks*